343-872
6/22/76 XR SR 3,965,474

United States Patent [19]
Guerrino et al.
[11] 3,965,474
[45] June 22, 1976

[54] ANTENNA FOR RECEIVING VLF/LF TRANSMISSION IN SEAWATER

[75] Inventors: David L. Guerrino, Woodbridge, Va.; Richard W. Cole, Jr., Waldorf, Md.

[73] Assignee: The United States of America as represented by the Secretary of the Navy, Washington, D.C.

[22] Filed: Sept. 26, 1975

[21] Appl. No.: 617,229

[52] U.S. Cl. ..... 343/719; 343/788; 343/872

[51] Int. Cl.[2] ..... H01Q 1/04

[58] Field of Search ..... 343/709, 710, 719, 788, 343/872, 873

[56] References Cited

UNITED STATES PATENTS 3,495,209 2/1970 Engle ..... 343/719

*Primary Examiner*—Eli Lieberman
*Attorney, Agent, or Firm*—R. S. Sciascia; Philip Schneider; George A. Montanye

[57] ABSTRACT

An improved device and technique for improving the reception of very-low-frequency and low-frequency transmissions in seawater. A loop antenna, wound on a ferrite core, is encapsulated in a water impermeable housing. Non-conducting elements are attached to the housing and extend outwardly therefrom to serve as barriers to conduction currents in the seawater. By varying the dimensions and number of the non-conducting members, the quality factor of the loop antenna can be increased to provide improved reception of VLF/LF signals.

10 Claims, 6 Drawing Figures

ANTENNA FOR RECEIVING VLF/LF TRANSMISSION IN SEAWATER

BACKGROUND OF THE INVENTION

The present invention relates to loop antenna systems and more particularly to improved devices and techniques for enabling reception of VLF/LF electromagnetic transmissions in seawater.

As is known, the reception capabilities of loop antennas are dependent upon the quality factor Q which is defined as $$Q = \frac{2\pi fL}{R}$$

where the frequency $f$ is in hertz, the inductance $L$ in henries, and the antenna resistance $R$ in ohms. Generally, as the value of $Q$ increases, the reception capabilities of loop antennas exhibit a corresponding increase. In situations where loop antennas are in close proximity to conductive mediums, however, the antennas will magnetically couple to such mediums causing the coupled resistance, which is included in $R$, to increase and reduce the value of $Q$. Naturally, as the conductive mediums are removed in distance from the loop antenna, coupled losses will also decrease causing a corresponding increase in $Q$.

When an insulated loop antenna is submerged in seawater, the antenna quality factor also responds in a manner similar to that described above, with the quality factor increasing as the separation between the antenna and the conductive seawater is increased. Energy coupled from the antenna to the seawater sets up a conduction current in the seawater that flows around the antenna and effectively acts as a shorted turn around the antenna. The shorted turn then acts to dissipate energy that reduces the value of antenna $Q$ as previously described. Since the sensitivity of the antenna to electromagnetic transmissions depends on the maintenance of a certain value of $Q$, the reduction of the $Q$ value when submerged in seawater seriously affects antenna operation.

In an effort to prevent reduction in antenna sensitivity under submerged conditions, it was necessary in prior known techniques to enclose the antenna in large radome structures to insulate the antenna from the surrounding seawater. As the size of the radomes were increased, a greater separation between seawater and antenna resulted in a larger value of $Q$ and better reception of electromagnetic transmissions. In a particular application to submarine towed watertight communications buoys, the buoy itself served as the radome housing the loop antenna and provided sufficient values of $Q$ to allow acceptable operation. Since the proximity of the seawater determines the $Q$, however, such radome structures were required to be large (coupled with increased weight) in order to provide acceptable $Q$. In addition to being very costly, such large radomes were cumbersome and provided increased drag when towed as communications buoys. Further, any attempts to make the communications buoys free flooding, to reduce complexity or cost, correspondingly reduced the antenna $Q$ to an unacceptable value or required the loop antenna to be housed in a separate radome structure. In either case, such techniques were at best limited in flexibility and costly in providing for the use of loop antennas in a seawater environment.

Accordingly, the present invention has been developed to overcome the specific shortcomings of the above known and similar techniques, and to provide a technique for improving loop antenna reception.

SUMMARY OF THE INVENTION

It is therefore an object of the present invention to provide a loop antenna structure designed to allow improved operation in proximity to conductive mediums.

Another object of the invention is to eliminate the need for large radome and housing structures to reduce the resistance coupling of loop antennas to conductive surroundings.

A further object of the invention is to provide a technique for improving the reception of very low frequency and low frequency electromagnetic transmissions with loop antennas.

Still another object of the invention is to reduce the conduction currents surrounding a loop antenna in seawater to improve the quality factor $Q$.

In order to accomplish these and other objects, the present invention employs an encapsulated loop antenna having non-conducting elements extending outwardly from the encapsulating housing. The housing is made of electrically insulating material that fits closely about the loop antenna to form a radome of reduced size to seal the antenna against contact with seawater in a manner similar to standard radomes. The non-conducting elements in the form of flat strips are attached to extend along the length of the antenna and positioned about the circumference so as to extend outwardly from the antenna in such manner as to reduce conduction currents normally circulating around the antenna. By increasing the width of the strips and the number of the strips employed, the quality factor $Q$ can also be increased inspite of the close proximity of the conductive seawater to the loop antenna. In addition to reducing the size and weight of the antenna structure, the use of large space consuming radomes is eliminated, and the use of the antenna with free flooding buoys is provided.

Other objects, advantages, and novel features of the invention will become apparent from the following detailed description of the invention when considered with the accompanying drawings wherein:

DETAILED DESCRIPTION OF A PREFERRED EMBODIMENT

Figure 1B:
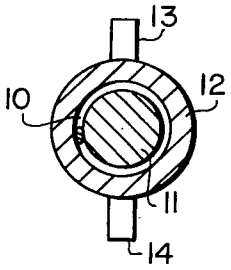
FIGS. 1*b* and 2*b* are cross sections of the FIGS. 1*a* and 2*a*, respectively, taken along the line *bb*.

Referring now to the drawings, FIGS. 1 and 2 generally show the technique utilized to improve antenna performance in a conductive seawater environment. The antenna assembly basically consists of a loop antenna 10 wound on a ferrite rod 11 enclosed within an electrically non-conducting housing 12. The assembly can be formed using a one inch diameter ferrite rod 11 enclosed within a 2 inch (outside diameter) plastic tube 12 which is sealed against water entry to provide a small insulating radome for the antenna while providing lead access at one end thereof. As would normally be expected, the quality factor of such an antenna assembly will be very low when submerged in seawater due to the close proximity of the seawater allowing circulating conduction currents.

Figure 1A:
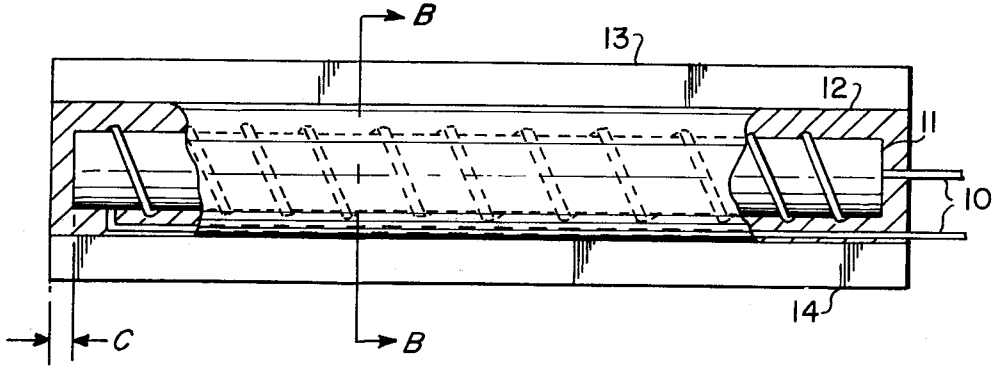
FIGS. 1*a* and 2*a* are schematic diagrams showing the use of projection strips to decrease current circulation about loop antennas.

According to the present invention, however, and in particular the embodiment of FIGS. 1*a* and 1*b*, projections 13 and 14 are attached along the length of the tube 12 and extend outwardly therefrom. In this specific example, the projections are in the form of dielectric strips attached to the tube diametrically opposite to one another which act as barriers to the circulating conduction currents described above. By varying the width and the number of the strips attached to the tube, the value of $Q$ can be adjusted in the seawater environment by reducing the value of coupled resistance affecting the antenna $Q$. Inspite of the close proximity of the conductive medium, therefore, the sensitivity of the loop antenna will be improved for better reception of VLF and LF electromagnetic transmissions.

Figure 2B:
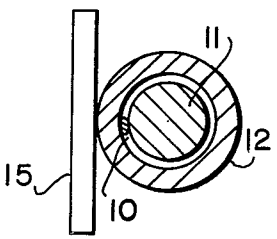
Figure 2A:
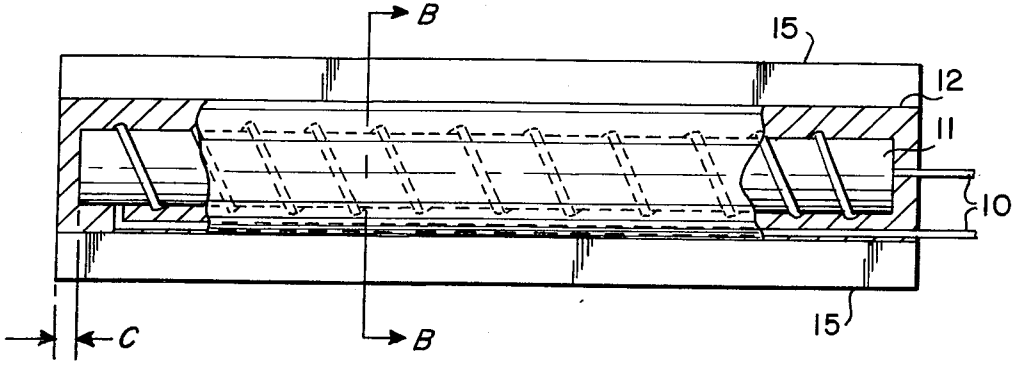

In another embodiment of the present invention as shown by FIGS. 2*a* and 2*b*, a plate 15 was substituted in lieu of the strips 13 and 14. The plate 15, also of dielectric material, is positioned such that the effect is to provide barrier projections on either side of the tube in much the same manner as the strips attached to tube in FIG. 1. The tube containing the antenna is attached to extend lengthwise along the center of the strip so that projections of equal width extend from either side of the tube when viewed as in FIG. 2*a* and 2*b*. While the configuration of FIG. 2 is less complex in construction, the embodiment of FIG. 1 allows for more flexible control of antenna $Q$ as might be desired in some instances.

Using the above configurations of FIGS. 1 and 2, a series of tests was performed to illustrate the effect of strip width and numbers on the quality factor of the loop antenna. The loop antenna was wound on a 28 inch long ferrite rod to have an in air inductance of 742 microhenries and an in air $Q$ of 176. When the antenna was sealed in the plastic tube as previously described and placed in 4 MHOS/meter simulated seawater, the $Q$ of the antenna was found to drop to below a value of 32. Measurements were then taken at 20 kHz to determine the change in $Q$ as the number and width of the strips 13 and 14 were changed. In the first instance a strip 13 of 2.5 inches was used without a strip 14 and the value of $Q$ measured at 37. Strip 14 was then attached, also having a width of 2.5 inches, and the value of $Q$ measured at 42. The width of strip 13 was then increased to 9.5 inches (with 14 still at 2.5 inches) and the value of $Q$ measured at 55. Finally, both strips 13 and 14 were attached with widths of 9.5 inches and the value of $Q$ measured at 62. As can be seen, the effect of the strips is to increase the value of $Q$ whenever the strips are made wider or more strips attached to the tube at different points along the circumference.

On tests of the configurations of FIG. 2, a dielectric plate 18 inches wide was substituted for the strips 13 and 14. When measured, the value of $Q$ was found to be 60 in the simulated seawater surroundings. It therefore appears that the use of the plate or strip configuration provides equal improvement in the value of $Q$ for a submerged loop antenna. In one example, however, the strip configuration will allow more flexibility in adjusting the value of $Q$ to a given level or in adapting the antenna assembly to particular size or space configurations, while in the other example, the plate configuration will provide substantially the same antenna $Q$ with a less complex and more structurally rigid assembly. In either case it should be noted that while the width and number of projections effects the value of $Q$, it was found that reducing the water separation on the ends of the antenna (dimensions $c$ in FIGS. 1 and 2) to as little as three eighths inch had no effect on the antenna $Q$.

Figure 3:
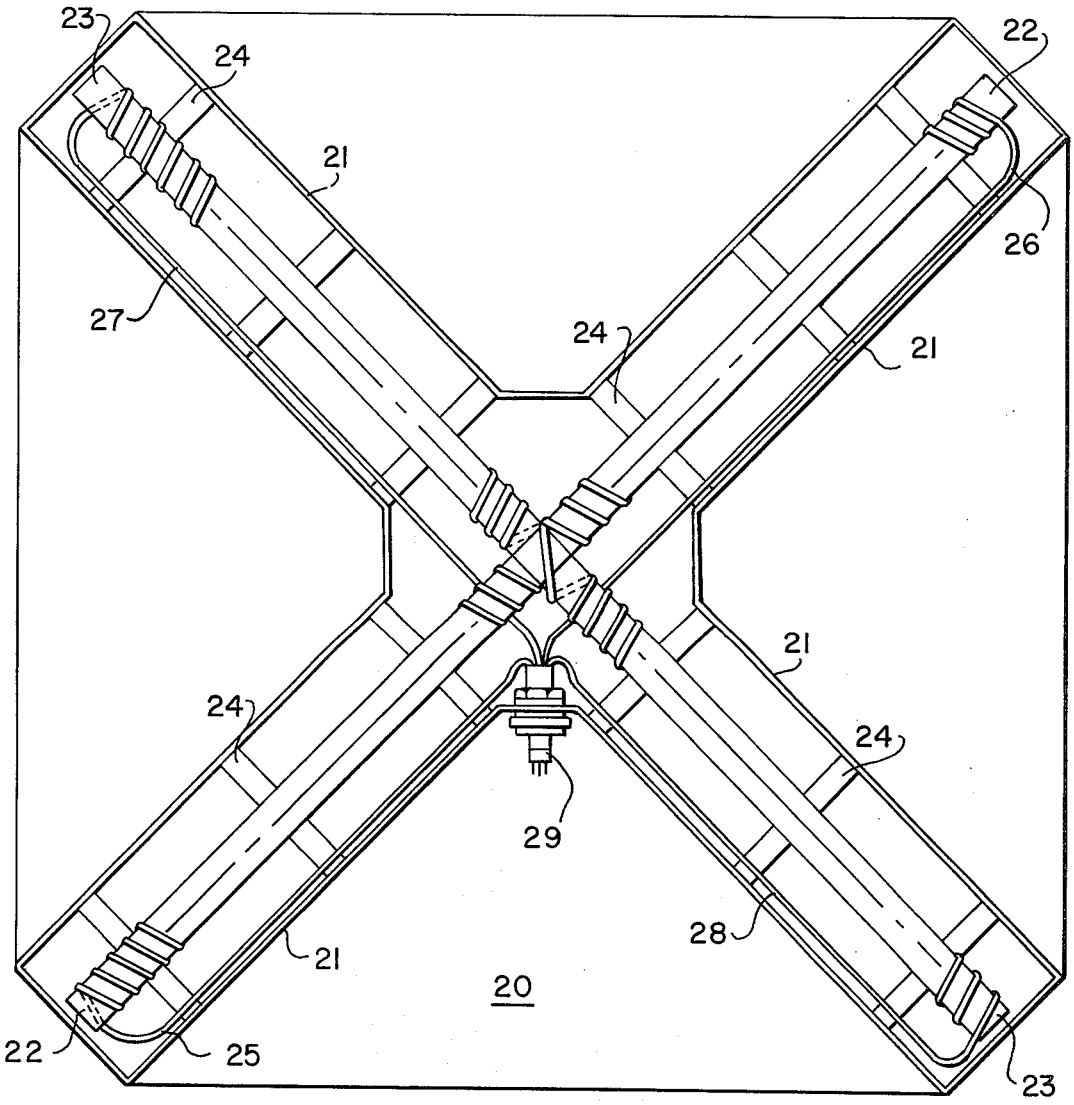
FIG. 3 is a plan view of a loop antenna assembly constructed according to the teachings of the present invention.
Figure 4:
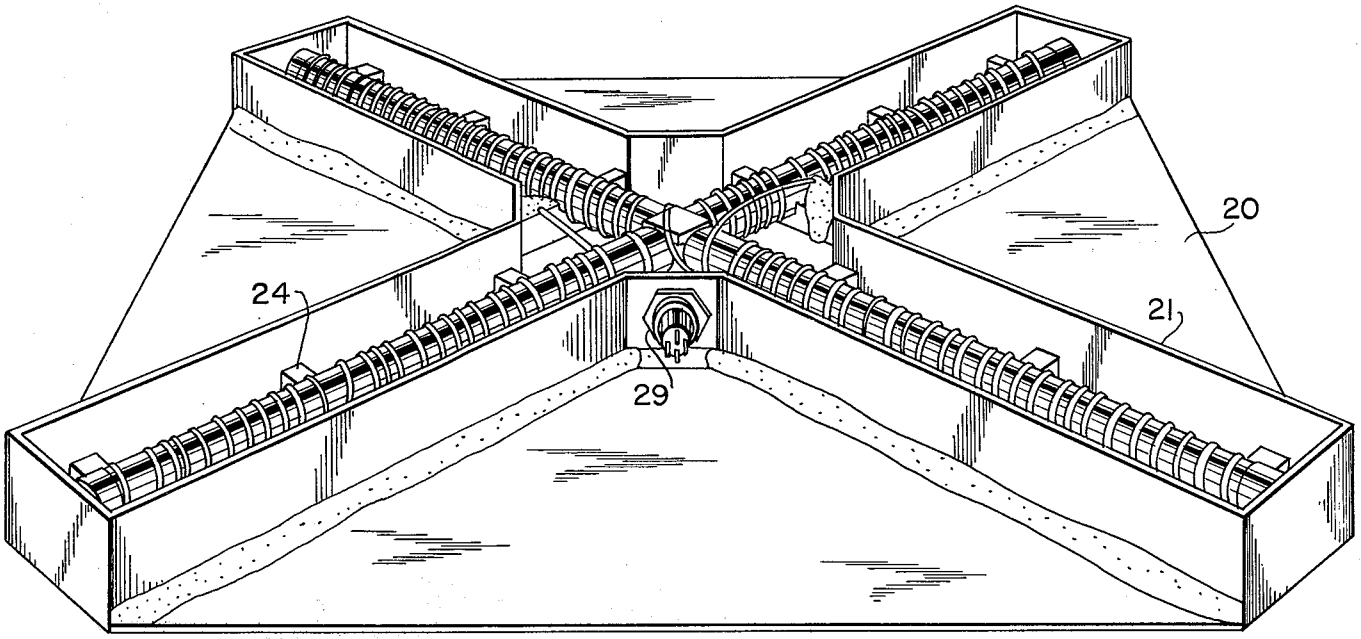
FIG. 4 is a perspective view of the assembly of FIG. 3 prior to final encapsulation of the assembly.

Using the techniques illustrated by the above embodiments of FIGS. 1 and 2, a common core antenna assembly was constructed as shown in FIGS. 3 and 4. The antenna was fabricated using 1 inch diameter ferrite rods 22 and 23 joined together at the center to form the shape of a cross. Each of the two legs of the cross were 31 15/16 inches long and wound with approximately 60 equally spaced turns of Litz wire to form a loop antenna with an in air inductance of 750 microhenries. The two leads 25, 26 and 27, 28 were then soldered to a four pin connector 29 which was moulded into the antenna assembly including the backing plate 20 and the walls 21. The plate 20 was constructed from a 26 inches square ⅛ inch fiberglass sheet on which was mounted 2 inch wide strips 21 (of the same ⅛ inch fiberglass) to form generally rectangular troughs 4 inches wide, also in the configuration of a cross, to accept the loop antenna structure. Each of the legs of the loop antenna was supported in the trough by syntactic foam (epoxy resin) suppots 24 positioned to hold the loop antennas in a stationary and stable position within the enclosure formed by the troughs. The antenna was then covered with a syntactic foam encapsulant, chosen to have low water absorption, low density, and high flexural strength, and sealed with fiberglass strips over each of the troughs to render the structure water impermeable.

In tests of the above antenna it was found that after curing of the syntactic foam the in air inductance had changed to about 735 microhenries with an in air $Q$ of 230 at 20 kHz. When submerged in seawater the antenna $Q$ dropped to about 75 due to the proximity of the seawater to the antenna, but still remained at a level for good VLF/LF reception due to the plate barrier 20 reducing the circulating conduction currents about the loop antennas. In contrast to prior antenna assemblies, the common core antenna assembly described above enabled the use of a dielectric housing (fiberglass) of high strength but reduced weight and size while still maintaining an acceptable value of $Q$ for improved antenna sensitivity. In addition, the loop antennas were able to be used with a free flooding communications buoy thereby eliminating the need for separate radome structure for the antenna.

As can be seen from the above description, the present invention enables improved reception of very low frequency and low frequency transmissions in seawater by controlling antenna $Q$. Using only simple dielectric projection attachments, the size of the antenna housing can be substantially reduced while still increasing the value of $Q$. The use of such simplified structures enables the antenna assembly to be greatly reduced in size and weight (and therefore cost) and allows much more flexibility in the use of the antenna systems in particular environments having limited space restrictions. By attaching more dielectric strips or increasing strip or plate width, the antenna Q can easily be increased or adjusted to a selected value. All of these are advantages not found in prior techniques as previously described.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. An apparatus for providing improved reception of very low frequency and low frequency transmissions in seawater comprising:

a loop antenna;

a non-conductive housing enclosing said loop antenna; and projection means attached to said housing for reducing circulating conduction currents about said antenna.

2. The apparatus of claim 1 wherein said projection means comprises at least one dielectric strip attached to said housing and extending outwardly therefrom.

3. The apparatus of claim 2 wherein said at least one strip comprises a pair of dielectric strips attached diametrically opposite to one another on said housing.

4. The apparatus of claim 3 wherein each of said strips extends outward from said housing by an equal amount along the length of said strips.

5. The apparatus of claim 1 wherein said projection means comprises a dielectric plate attached to said housing to form at least one projection outward from said housing.

6. A method of increasing the sensitivity of loop antennas in close proximity to a conductive medium comprising:

sealing a loop antenna in a non-conductive housing;

placing a conductive medium in close proximity to said housing; and attaching dielectric projections to said housing which extend outwardly therefrom so as to reduce circulating conduction currents in said medium about said antenna.

7. The method of claim 6 wherein said sealing step comprises sealing said antenna in a liquid impermeable housing and said placing step comprises submerging said housing in a conductive liquid medium.

8. The method of claim 7 wherein said liquid medium is seawater.

9. The method of claim 8 wherein said step of attaching comprises attaching strips to said housing such that the quality factor of the antenna can be changed by varying the width and number of strips.

10. The method of claim 8 wherein said step of attaching comprises attaching a dielectric plate to said housing to form said projections.

* * * * *